US008901491B2

(12) United States Patent
Brekenfeld et al.

(10) Patent No.: US 8,901,491 B2
(45) Date of Patent: Dec. 2, 2014

(54) EJECTION OF ION CLOUDS FROM 3D RF ION TRAPS

(71) Applicant: Bruker Daltonik GmbH, Bremen (DE)

(72) Inventors: Andreas Brekenfeld, Bremen (DE); Christoph Gebhardt, Bremen (DE); Ralf Hartmer, Hamburg (DE)

(73) Assignee: Bruker Daltonik, GmbH, Bremen (DE)

( * ) Notice: Subject to any disclaimer, the term of this patent is extended or adjusted under 35 U.S.C. 154(b) by 0 days.

(21) Appl. No.: 13/927,224

(22) Filed: Jun. 26, 2013

(65) Prior Publication Data

US 2014/0008533 A1 Jan. 9, 2014

(30) Foreign Application Priority Data

Jun. 29, 2012 (DE) ..... 10 2012 013 038

(51) Int. Cl.
*H01J 49/26* (2006.01)
*H01J 49/42* (2006.01)

(52) U.S. Cl.
CPC ..... *H01J 49/424* (2013.01); *H01J 49/425* (2013.01)
USPC ..... 250/292; 250/281; 250/287; 250/288; 250/290

(58) Field of Classification Search
CPC ..... H01J 49/02; H01J 49/06; H01J 49/005; H01J 49/004; H01J 49/0072; H01J 49/424; H01J 49/425; H01J 49/426; H01J 49/427; H01J 49/428; H01J 49/429; H01J 49/26; H01J 49/0081; H01J 49/145; H01J 49/4225; H01J 49/4245; H01J 49/0037; H01J 49/4295
See application file for complete search history.

(56) References Cited

U.S. PATENT DOCUMENTS

| | | | | |
|---|---|---|---|---|
| 4,736,101 | A * | 4/1988 | Syka et al. | 250/292 |
| 5,396,064 | A * | 3/1995 | Wells | 250/282 |
| 5,399,857 | A * | 3/1995 | Doroshenko et al. | 250/292 |
| 6,140,641 | A * | 10/2000 | Yoshinari et al. | 250/292 |
| 6,759,652 | B2 * | 7/2004 | Yoshinari et al. | 250/292 |
| 6,977,373 | B2 * | 12/2005 | Yoshinari et al. | 250/292 |
| 7,186,973 | B2 * | 3/2007 | Terui et al. | 250/287 |
| 7,285,773 | B2 * | 10/2007 | Ding et al. | 250/282 |
| 7,329,866 | B2 * | 2/2008 | Wang | 250/290 |
| 7,456,396 | B2 * | 11/2008 | Quarmby et al. | 250/292 |
| 7,582,862 | B2 * | 9/2009 | Hartmer | 250/282 |
| 7,615,742 | B2 * | 11/2009 | Brekenfeld | 250/282 |

(Continued)

FOREIGN PATENT DOCUMENTS

| | | | |
|---|---|---|---|
| EP | 2309531 | A1 | 4/2011 |
| JP | 201114472 | A1 | 1/2011 |
| WO | 9939368 | A2 | 8/1999 |

*Primary Examiner* — David A Vanore
(74) *Attorney, Agent, or Firm* — Robic, LLP

(57) ABSTRACT

The invention proposes a method for the collective ejection of ions from a 3D RF ion trap with a ring electrode and two end cap electrodes, which comprises the following steps: (a) the RF voltage of a high-quality resonant circuit applied to the ring electrode is replaced with a second RF voltage at the two end cap electrodes which can be changed or switched faster than the high voltage at the ring electrode, keeping the ions stored, (b) the second RF voltage at the end cap electrodes is then switched down or off abruptly, releasing the ions, and (c) the released ions are ejected through an opening in one of the end cap electrodes by switching on a DC voltage on at least one of the end cap electrodes.

19 Claims, 3 Drawing Sheets

(56) References Cited

U.S. PATENT DOCUMENTS

| | | | | |
|---|---|---|---|---|
| 7,842,918 | B2 * | 11/2010 | Wang | 250/290 |
| 8,319,180 | B2 * | 11/2012 | Nikolaev et al. | 250/290 |
| 8,384,019 | B2 * | 2/2013 | Koster et al. | 250/281 |
| 2002/0005479 | A1 * | 1/2002 | Yoshinari et al. | 250/288 |
| 2002/0195559 | A1 * | 12/2002 | Miseki | 250/292 |
| 2004/0149903 | A1 * | 8/2004 | Wang | 250/292 |
| 2006/0186331 | A1 * | 8/2006 | Hartmer et al. | 250/288 |
| 2008/0093546 | A1 * | 4/2008 | Hartmer | 250/282 |
| 2013/0037711 | A1 * | 2/2013 | Koster | 250/288 |
| 2013/0146761 | A1 * | 6/2013 | Koster et al. | 250/288 |
| 2014/0008533 | A1 * | 1/2014 | Brekenfeld et al. | 250/288 |

* cited by examiner

EJECTION OF ION CLOUDS FROM 3D RF ION TRAPS

BACKGROUND OF THE INVENTION

1. Field of the Invention

The invention relates to the collective ejection of ions from three-dimensional Paul RF ion traps, particularly for their transfer to Kingdon ion traps or other mass analyzers.

2. Description of the Related Art

Mass spectrometers can only ever determine the ratio of the ion mass to the charge of the ion. In the following, the term "mass of an ion" or "ion mass" always refers to the ratio of the mass m to the dimensionless number z of excess positive or negative elementary charges of the ion, i.e. the elementary charge related mass m/z (or charge related mass, for short). There are various criteria for characterizing the performance of a mass spectrometer, the key one being the mass resolution. Mass resolution is usually defined as $R=(m/z)/\Delta(m/z)=m/\Delta m$, where R is the resolution, m the mass of an ion, measured in units of the mass scale, and $\Delta m$ the width of the mass signal at half maximum, measured in the same units. A special feature of radio-frequency ion traps (RF ion traps) is that R increases in proportion to m, which means that the signal width $W_{IT}=\Delta m$, measured in units of the mass scale, remains constant with mass, and can simply regarded as a kind of mass resolution of the ion trap.

A three-dimensional Paul RF ion trap (3D RF ion trap) consists of two end cap electrodes and one ring electrode, as shown in FIG. 1. All electrodes usually have rotationally hyperbolic surfaces. High quality ion traps are operated with RF voltages of up to 30 kilovolts peak-to-peak and frequencies of around one megahertz. They form a quadrupole pseudopotential well inside the ion trap, with a quadratic increase of the pseudopotentials extending uniformly from the center of the ion trap in all three dimensional directions. In this pseudopotential well, the ions can oscillate harmonically through or about the center with a mass-dependent "secular frequency" (as if they were in a trough of real potentials, although this cannot be realized for all spatial directions simultaneously with electrostatic potentials). The ion traps are usually operated with a damping gas at a pressure of 0.1 to 1.0 pascal in order to damp ("cool") the ion oscillations in the pseudopotential well of the ion trap, so the ions gather in the center. The damping process reduces the oscillation amplitudes exponentially with a time constant of a few tenths of a millisecond, so the ions come to rest in the form of a small cloud after around one to two milliseconds. The cloud has the shape of a flat ellipsoid of rotation. The diameters of the cloud in the axial and transverse directions result from the balance between space-charge forces acting centrifugally and forces of the pseudopotential acting centripetally. Under optimum operation conditions, the larger diameter in the transverse direction is of the order of a half to a full millimeter.

The ions can be ejected from the center through an opening in one of the end cap electrodes in ascending order of their mass-to-charge ratio m/z by means of special scan methods, usually by resonance excitation with an excitation high frequency voltage across the end cap electrodes. The ion current which leaves the trap can be measured with an ion detector as a function of time: this operation results in a mass spectrum. In high-quality ion trap mass analyzers, at scan speeds of 30,000 daltons per second, it is possible to achieve mass widths of around $W_{IT}=0.2$ dalton in mass ranges up to 3000 daltons. At a mass of m=200 Da, this corresponds to a resolution of only $R_{(200\ Da)}=1000$; in higher mass ranges $R_{(1000\ Da)}=5000$ and $R_{(3000\ Da)}=15{,}000$ are achieved. These mass resolutions are only moderately good in the lower and medium mass range.

In radio-frequency ion traps, the ions can be manipulated in numerous ways. It is possible, for example, to "isolate" individual ion species by ejecting all other ion species by means of resonance or other processes. The isolated ions can be fragmented by collision-induced dissociation (CID) or by electron transfer (ETD) of suitable negative radical ions, for example. Electron transfer dissociation has the best yield of fragment ions in 3D RF ion traps, far better than in the linear two-dimensional RF ion traps (2D RF ion traps) which are usually used for this process. The 3D RF ion traps thus form a tandem mass spectrometer by themselves for the acquisition of fragment ion spectra ("tandem in time"). The isolated ions can also be subjected to quite different reactions; it is possible to reduce the charge number of multiply positively charged ions. These diverse possibilities make the 3D RF ion trap an excellent research tool for determining the structure of ions, their identity, their reactivity and many other properties. Moreover, 3D RF ion traps have a very high sensitivity, comparatively speaking, which opens up many fields of application.

These outstanding possibilities are accompanied by only a single disadvantage: the mass resolution and the associated mass accuracy are only moderately good. There is therefore a need for a device which combines the 3D RF ion trap, with its good ion manipulation possibilities, with a mass analyzer of maximum mass resolution. Ion cyclotron resonance mass spectrometers (ICR-MS), time-of-flight mass spectrometers (TOF-MS), and particularly Kingdon ion traps can be used as this type of mass analyzer.

Kingdon ion traps are generally electrostatic ion traps in which ions can orbit one or more inner electrodes or oscillate between several inner electrodes. An outer, enclosing housing is at a DC potential which the ions with a given total energy (sum of kinetic and potential energy) cannot reach. In special Kingdon ion traps, which are suitable as mass analyzers, the inner surfaces of the housing electrodes and the outer surfaces of the inner electrodes are designed so that, firstly, the motions of the ions in the longitudinal direction of the Kingdon ion trap are decoupled from their transverse motions as completely as possible and, secondly, a parabolic potential profile is generated in the longitudinal direction in which the ions can oscillate harmonically in the longitudinal direction. In this publication, the term "Kingdon ion trap" refers only to these special forms in which ions can oscillate harmonically in the longitudinal direction, decoupled from their transverse motions as far as possible. This harmonic oscillation is mass-dependent. If the image currents of these oscillations are measured at suitable electrodes, a Fourier analysis can be used to obtain a frequency spectrum, which is then converted into the mass spectrum. As with other Fourier transform mass spectrometers, for example ion cyclotron resonance mass spectrometers, a very high mass resolution R can be achieved for ions of the lower and medium mass range in particular. In Kingdon ion traps, a mass resolution of $R_{(200\ Da)}=100{,}000$ can easily be achieved for ions with a mass of m=200; for this, the measurement of the image current transient must have a specific duration. However, for the same measurement duration, mass resolution decreases toward higher masses in inverse proportion to the square root of the mass, so at m=3200 Da, a mass resolution of $R_{(3200\ Da)}=25{,}000$ is still achieved. Coupling a 3D Paul RF ion trap to a Kingdon ion trap therefore provides an ideal solution when good mass resolution for ions of lower masses is required.

Coupling 3D Paul R F ion traps to Kingdon ion traps has already been proposed in the document DE 10 2009 020 886 A1 (C. Köster and J. Franzen; corresponding to GB 2 470 259 A, US 2013/0146761 A1, US 2010/0301204 A1), but without stating how the different ion species can be ejected without this having a detrimental effect on the normal operation of a mass spectrometer based on the 3D RF ion trap.

The patent specification U.S. Pat. No. 5,886,346 A (A. A. Makarov) elucidates the fundamentals of a Kingdon ion trap which is marketed by Thermo-Fischer Scientific GmbH Bremen under the name Orbitrap®. The Orbitrap® has a spindle-shaped inner electrode within the coaxial housing electrode, which is split transversely in the center. An ion-optical device is used to inject the ions tangentially as ion packets; they then orbit in an electric potential between inner electrode and housing. The transversely orbiting ions execute harmonic oscillations longitudinally in a parabolic potential well and induce image currents in the electrodes of the housing, which are shaped like a half shell; these image currents can be measured in the form of image current transients and converted into mass spectra.

The patent specification DE 10 2007 024 858 B4 (C. Köster; corresponding to U.S. Pat. No. 7,994,473 B2; GB 2 448 413 B) describes other types of Kingdon ion trap characterized each by the arrangement of several inner electrodes. In this case, also, the inner electrodes and the outer housing electrodes can be precisely shaped in such a way that the longitudinal motion is decoupled from the transverse motion, and a parabolic potential well is created in the longitudinal direction to generate a harmonic oscillation. The embodiments also include those where the analyte ions can oscillate transversely, practically in one plane, in the center plane between at least one pair of inner electrodes; an example is given in FIG. 2. The analyte ions oscillating transversely in this way can then execute harmonic oscillations in the longitudinal direction, and the image current of these oscillations can be measured in order to produce highly resolved mass spectra.

Kingdon ion traps must be operated under ultra-high vacuum if ions are to be stored for a length of time, say a few seconds. During this time the ions must not suffer any collisions with the residual gas because they would then lose kinetic energy and finally hit the inner electrode arrangement. These prolonged storage times are necessary in order to measure the longitudinal oscillation frequencies for high mass resolutions. The measuring times for high resolutions range from a few tenths of a second to a few seconds. The ion species to be analyzed are preferably pulsed into a Kingdon ion trap in as short a time as possible; the (shortest) oscillation period of the lightest ion species in the Kingdon ion trap often determines the time which is available for the introduction of all the other ion species (acceptance time).

The combination of a 3D RF ion trap and a Kingdon ion trap, which is described above as being optimal, is difficult if the 3D RF ion trap is still to be operated as a high-quality mass analyzer, however. The collective ejection of the ions from the 3D RF ion trap requires the RF voltage, which serves as the storage voltage, to be switched off abruptly, preferably within a single RF period. But a 3D RF ion trap which is also operated as a mass analyzer is usually operated in resonance with an RF resonant circuit of high quality and low effective resistance because this is the only way to keep the energy consumption low and achieve extremely high voltages. The quality Q is defined as $Q=1/\tan\delta$, where $\delta$ is the loss factor. High quality means high resonance sharpness. An RF voltage generated with high-quality resonance in this way cannot be switched off abruptly, however. The resonant circuit simply continues to oscillate when the energy input is switched off; installing a short-circuit switch interferes with the quality of the resonant circuit. The quality of the resonance switching circuit in RF ion traps is around a few hundred, i.e. the amplitude of the RF voltage after the energy input has been switched off decreases over a few hundred RF periods, and thus in around a hundred microseconds.

The collective ejection of ion species of different masses from RF ion traps which are not used as high-quality mass analyzers has been described at various places in the literature.

Document U.S. Pat. No. 7,498,571 B2 (A. A. Makarov et al., granted 2009) describes the ejection from an RF storage device, where the storage unit can be either a 3D RF or a 2D RF ion trap. This is expressly operated solely as an ion storage device, however, and not as a mass analyzer; but it is operated with an RF voltage in resonance via the secondary winding of a transformer, as is usual for mass analyzers. The RF voltage can be switched off abruptly for the ejection by means of a short-circuit switch with a short-circuit resistance (shunt). This circuit configuration is only possible if the maximum RF voltage amounts to only a few hundred volts, but not when a top-quality secondary circuit is required to supply RF voltages of up to several ten kilovolts. In this case any connection with switches or similar has an interfering effect; the switch would also have to be high-voltage-proof, which usually makes it slow. Furthermore, experience shows that the energy content of a circuit with maximum quality cannot be destroyed in one RF period even when a shunt is used. Applicant considers this document to be the closest prior art.

The document U.S. Pat. No. 7,256,397 B2 (E. Kawato and S. Yamaguchi, granted 2007) describes an RF ion trap whose content is pulsed out axially into the flight path of a time-of-flight mass spectrometer. Here too, the RF ion trap is operated only as an ion storage system, so only relatively low RF voltages are required. The special feature here is that, by switching off the RF voltage at a specific phase and switching on the ejection pulse of the time-of-flight spectrometer with a time delay, a mode of operation can be achieved where the kinetic energy of the ions no longer depends on the RF voltage which existed before the pulsed ejection.

The document US 2008/0035842 A1 (M. Sudakov and L. Ding) describes how ions from a linear RF ion trap (2D ion trap) are pulsed axially in a direction radial to the rod system into the flight region of a time-of-flight mass spectrometer (TOF) or into a time-of-flight mass spectrometer with orthogonal acceleration of the ions (OTOF). The RF voltage has the form of a square-wave voltage here, i.e. it is not a sinusoidal voltage, in order to allow rapid switching to a stationary ejection state.

SUMMARY OF THE INVENTION

The present invention provides a method for the collective ejection of ions from a 3D RF ion trap which comprises the following steps: (a) the RF voltage generated with a resonant circuit at the ring electrode is replaced with a more rapidly switchable RF voltage at the two end cap electrodes to keep the ions stored, (b) the RF voltage at the end cap electrodes is switched down to release the ions, and (c) a DC voltage is applied to at least one of the end cap electrodes to eject the ions through an opening in one of the end caps.

The central idea of the invention is to replace the RF voltage at the ring electrode, which is generated in resonance with maximum quality, by an RF voltage at the end cap electrodes which can be switched faster, in comparison, when the ions are to be transferred to a different mass analyzer. The time for the transition between the two RF voltages is determined by the time needed to switch down the RF voltage at the ring electrode. Replacing the RF voltage at the ring electrode by a more rapidly switchable second RF voltage at the two end cap electrodes involves shutting down (switching off) the RF voltage at the ring electrode, thus reducing it to an amplitude which is no longer sufficient to store the ions in the 3D RF ion trap. The ions in the ion trap are kept in the ion trap during the transition by the second RF voltage at the end cap electrodes and can subsequently be ejected by switching down the second RF voltage and switching on a DC voltage pulse. The second RF voltage amplitude necessary for the storage is a few hundred volts, at most. The transition between the RF voltages takes considerably longer than the switching down of the second RF voltage at the end cap electrodes.

The RF voltage generated in high-quality resonance is supplied only to the ring electrode; it will be termed the "ring RF voltage" here. The high ring RF voltage of up to 30 kilovolts peak-to-peak is needed for the mass-sequential ejection in order to continue it up to very heavy ions of around m/z=3000 Da. Furthermore, it is also needed to isolate individual ion species. In contrast, voltages required for storing ions of a large mass range amount to only a few hundred volts. Since connecting the ring electrode with further circuit elements immediately reduces the quality of the RF ring circuit significantly, it is not possible to superimpose a different switchable RF voltage onto the RF ring circuit. The invention therefore proposes that the second RF voltage, which can be rapidly switched down, should be applied as a single phase RF voltage at both the two end cap electrodes together ("end cap RF voltage"). With a 3D RF ion trap, all that matters for storing ions is that an RF voltage is applied between the ring electrode, on the one hand, and the two end cap electrodes, on the other hand.

The more rapidly switchable end cap RF voltage can be generated by a circuit with a resonant circuit under strong damping conditions (especially outside a resonance) or by active electric switching elements (e.g. power transistors). It is particularly advantageous if the damping is close to the aperiodic creep case when a resonant circuit is used, i.e. after the energy supply has been turned off, the oscillation returns to the zero value of the voltage from the voltage which momentarily exists during the switch off, without overshooting. The damping can be produced by a suitably sized resistor in the resonant circuit. Furthermore, the end cap RF voltage can also be generated with a resonant circuit which is in resonance if the quality of the resonance circuit is lower than that of the resonance circuit with which the ring RF voltage is generated, and is actively switched. The resonance circuit for the end cap RF voltage can, for example, be switched at or near the maximum capacitive storage to a low-resistance short-circuit resistor, and thus be discharged with corresponding speed. It is also possible to switch over to an appropriately adapted alternative capacitor at or near maximum inductive storage. The characteristic of the amplitude of the end cap RF voltage can be sinusoidal, but it is also possible to use a square-wave voltage.

For the collective ejection of the ions, it is not imperative for the end cap RF voltage to be powered down (switched off) completely. The ions can also be successfully ejected when a small RF voltage still exists. This document therefore talks about "switching down" instead of switching off. The effect of the residual RF voltage on the ions should, however, be small compared to the ejecting force of the DC voltage. The switching down also comprises a switching over from the RF AC voltage to a DC voltage which pulls the ions to the end cap electrodes in the corresponding maximum of the amplitude characteristic. If an RF power amplifier is used to generate the rapidly switchable end cap RF voltage, the DC voltage of the ejection pulse can also be generated directly by this amplifier, e.g. by applying a corresponding temporal amplitude characteristic on its input side or storing it in an internal storage device.

A preferred operating mode for the 3D RF ion trap looks as follows: the ion trap is operated in the familiar way and also used as a mass analyzer as long as the ions it contains are not to be transferred to another mass analyzer. But if the ions in the 3D RF ion trap are to be transferred to another mass analyzer at some point in time, a second single-phase RF voltage is applied to both end cap electrodes. This end cap RF voltage allows the ions to be stored inside the ion trap when the ring RF voltage is powered down. The transition from the ring RF voltage to the end cap RF voltage typically takes a few hundred microseconds. The end cap RF voltage can then be switched down and a DC voltage pulse can be applied to at least one of the two end cap electrodes so as to be in phase, in order to eject all the ions together from the ion trap.

The RF voltages at the ring and end cap electrodes can be generated in such a way that they have opposite phase at the same frequency and the amplitudes are powered up or down in the contrary direction so that the same RF field is always present during the transition from the ring RF voltage to the end cap RF voltage. This would not disturb the ion cloud, which would keep its shape and size. However, this embodiment involves the risk that a coupling with the resonant circuit at the ring electrode would pump energy into this resonant circuit, and the RF voltage could then no longer be switched off easily. If the RF voltage which thus remains is unacceptable, it is better to choose a different frequency for the end cap RF voltage and to accept a brief disturbance of the ion cloud. Once the storage of the ions has transferred to the end cap RF voltage, a few milliseconds suffice to bring the ion cloud back to its quiescent formation. It is preferable if one of the two frequencies has a value which corresponds to an integer fraction of the frequency of the other RF voltage. It is also preferable if the two frequencies are coupled in phase-locked relationship. Also in the case of different frequencies, the amplitude of the RF voltage at the end cap electrodes may be increased while the amplitude of the RF voltage at the ring electrode is decreased.

After the storage of the ions has been transferred from the ring electrode RF voltage to the end cap RF electrode voltage, the end cap RF voltage can then be abruptly switched down and replaced with an ejecting DC potential. The end cap RF voltage does not need to be large in order to store the ions; voltages with a maximum of a few hundred volts are sufficient. These can be generated directly by appropriate power transistors, for example. The switching down is preferably done in a phase in or shortly before the zero crossing, particularly in the zero crossing where the ion cloud contracts. This usually leaves an RF or a DC voltage of a few volts, which then decreases exponentially with a half-value period of a few microseconds.

The ejecting DC potential is best applied as a suction voltage at the end cap electrode through whose opening the ions are to be ejected. The ions are then spatially focused toward the opening by the DC potential distribution in the interior of the ion trap, while a voltage at the other end cap electrode can be used for fine adjustment of the spatial focusing. It is advantageous to accelerate the ions to a relatively high speed by means of the suction voltage and of downstream acceleration lenses with several hundred volts so that the mass dispersion remains low during the transfer to a downstream mass analyzer.

The ejected ions are preferably transferred to a mass analyzer with high mass resolution, i.e. a mass analyzer with a mass resolution higher than that of the 3D RF ion trap. Different types of devices can be used as high-resolution mass analyzers, but particularly suitable is a Kingdon ion trap where the ions can oscillate transversely in a center plane between one or more pairs of inner electrodes, as is described in detail, in addition to other embodiments, in the aforementioned patent specification DE 10 2007 024 858 B4 (C. Köster). It is also possible, however, to use Kingdon ion traps, as have been disclosed in the patent specification U.S. Pat. No. 5,886,346 A (A. A. Makarov). Here we discuss only the former ion trap but without the intention to limit the scope of protection.

Along the path between 3D RF ion trap and Kingdon ion trap, which usually passes through several pumping stages, the ion species are spaced out according to their masses by the mass-dependent flight times in electric acceleration, deceleration and focusing fields; the light ions reach the Kingdon ion trap earlier than the heavy ions. The Kingdon ion trap must therefore be able to accept the ions during this time-of-flight difference. If desired, the ions can also be temporally focused by selecting the appropriate temporal characteristic of the DC voltage pulse. The temporal focusing preferably affects different ion species so that ions from as large a mass range as possible are able to enter the Kingdon ion trap within its acceptance time. If, for example, the DC voltage at the end cap electrodes is increased during the ejection, the heaviest ion species, which remains in the 3D RF ion trap for a longer time, is provided with more kinetic energy and can therefore catch up with the lightest ion species. Thus both ion species reach the inlet of the Kingdon ion trap with only a short time difference and can both be accepted by the Kingdon trap; the remaining ion species then reach the inlet of the Kingdon ion trap in between this period. Favorably, the heavy ions are decelerated directly at the entrance of the Kingdon ion trap to enter the trap with the same kinetic energy as the light ions.

A mass spectrometer according to the invention with a 3D RF ion trap, comprising a ring electrode and two end cap electrodes, has a first RF generator, with a resonant circuit, connected to the ring electrode. This mass spectrometer is characterized by the fact that a second RF generator is connected to the two end cap electrodes and a DC voltage generator is connected to at least one of the end cap electrodes. The two RF generators are switchable or controllable, and the second RF generator is able to change the generated RF voltage more rapidly than the first RF generator. The DC generator generates a pulsed DC voltage. The second RF generator and the DC voltage generator can be integrated in an RF power amplifier.

The mass spectrometer preferably comprises an ion source and a Kingdon ion trap, which is arranged in relation to the 3D RF ion trap in such a way that ions ejected from the 3D RF ion trap according to this invention can be transferred into the Kingdon ion trap directly or by ion-optical means.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Figure 1:
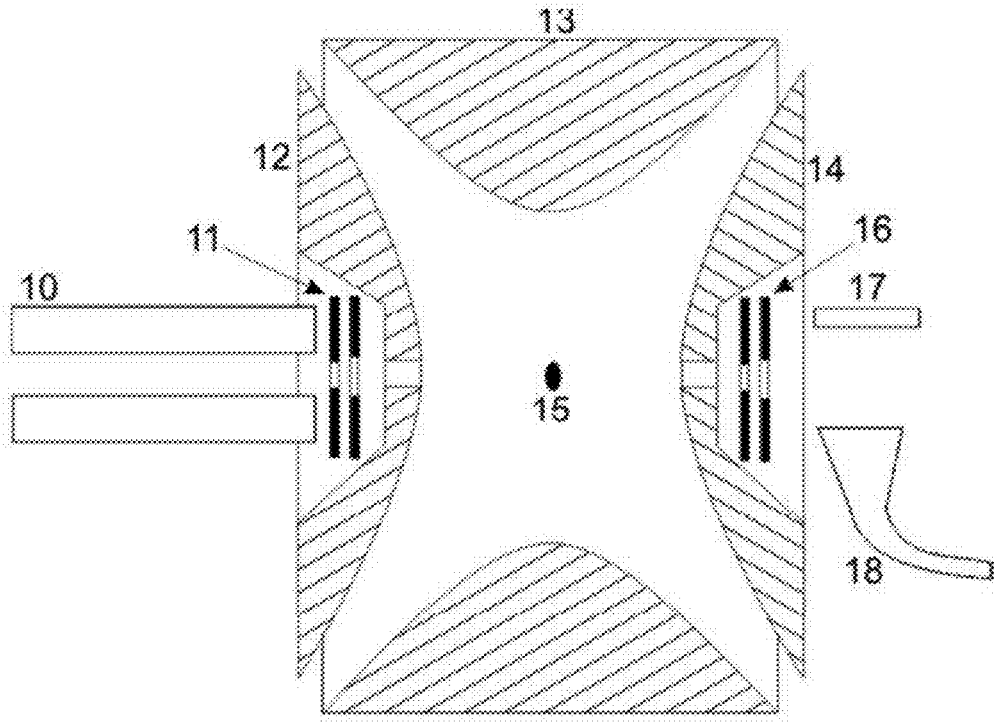
FIGURE 1 (PRIOR ART)
FIG. 1 depicts a mass analyzer according to the prior art with a 3D Paul RF ion trap. The mass analyzer comprises an introduction quadrupole (10), injection optics (11), the two end cap electrodes (12, 14), the ring electrode (13), ejection optics (16), an ion-electron converter (17) and a channeltron secondary electron multiplier (18). In the center, the ions form a small lenticular cloud (15), which usually has a diameter of only around 0.5 to 1.0 millimeter.
Figure 2:
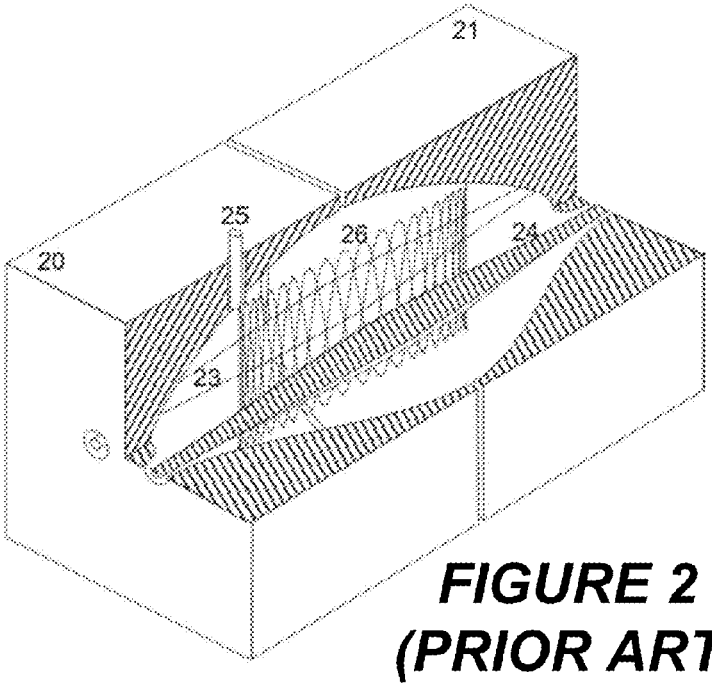
FIGURE 2 (PRIOR ART)
FIG. 2 is a three-dimensional representation of an electrostatic Kingdon ion trap of the oscillational type with a housing electrode, which is transversely divided in the center into two half shells (20 and 21), and two spindle-shaped inner electrodes (23, 24). The Kingdon ion trap can be filled with ions through an entrance tube (25); the ions then move on oscillational paths (26).
Figure 3:
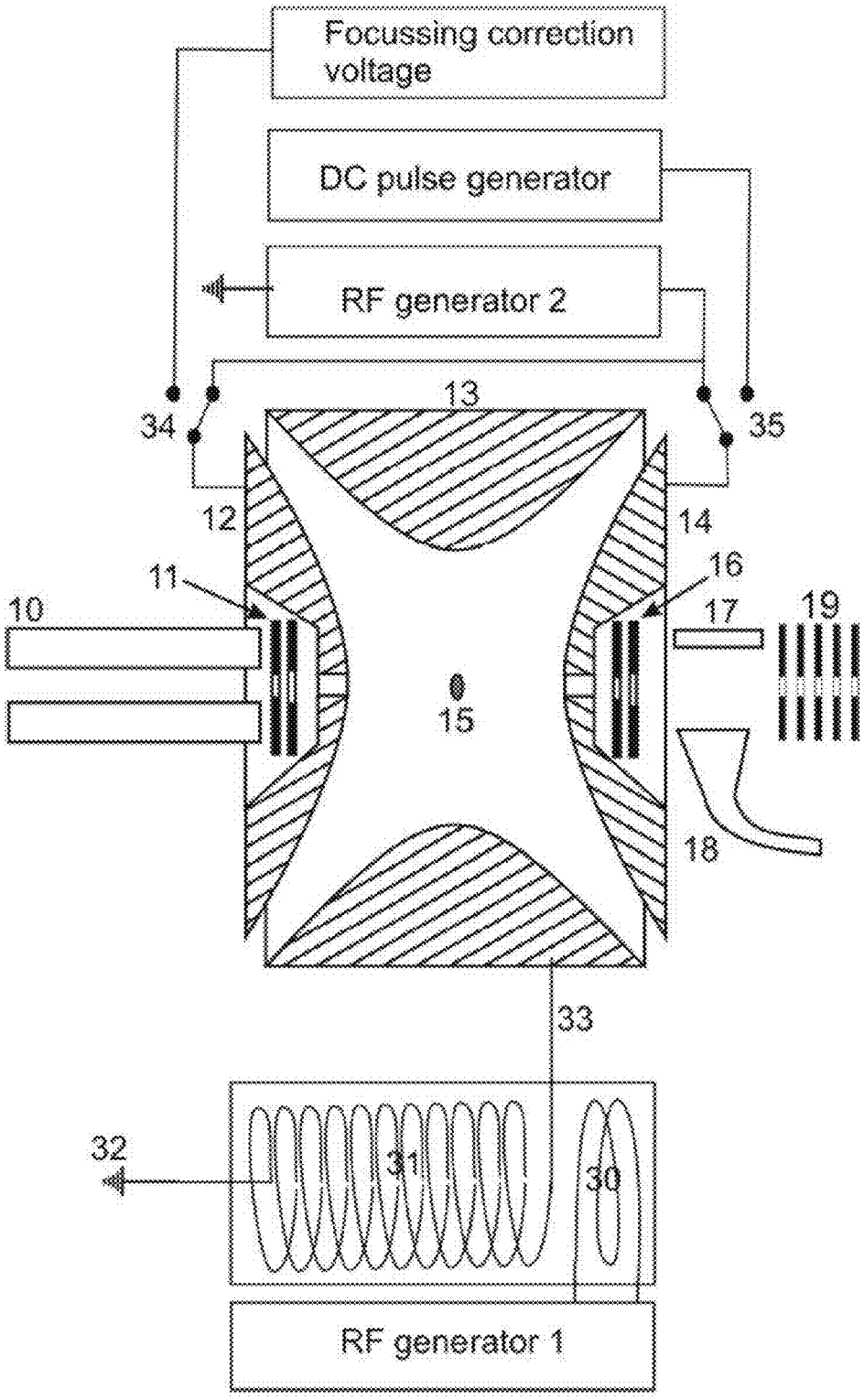
FIG. 3 is a schematic representation of the configuration of the 3D RF ion trap with the two RF voltage generators 1 and 2 and the generator for the DC voltage pulse, which effects the extraction of the ions. The RF voltage of generator 1 is generated by an air core transformer with primary coil (30) and secondary coil (31), and is applied to the ring electrode (13) in single phase via the supply line (33). The ring electrode (13) and secondary coil (31) form a high-quality resonant circuit in order to generate the 30 kilovolts peak-to-peak for the mass-selective ejection and mass-selective isolation of ions with low energy expenditure. The voltage is usually controlled by feedback, but it cannot be switched off rapidly due to the high quality of the resonant circuit. For this reason, the storage of the ions, which requires only a few hundred volts, is initially switched over to RF voltage generator 2, which is connected in single phase to the two end cap electrodes (12) and (14) together and, in the case of direct control, can be rapidly switched down (or off) with the aid of active electrical switching elements, without using a resonant circuit. After this RF voltage has been switched off, or even while it is being switched off, the DC voltages for the ion ejection and the focusing correction can be connected to the end cap electrodes by means of the changeover switches (34) and (35). The switches are only shown symbolically in the diagram; the effect can also be produced by other electronic circuits, it is also possible for RF generator 2 and the DC pulse generator to be integrated into an RF power generator.

FIG. 3 shows how the single-phase RF voltage for the ring electrode (13) of the 3D RF ion trap is generated by the secondary coil (31) at RF generator 1. The capacitance of the ring electrode (13), the inductance of the secondary coil (31) of the air core transformer, and the conductor resistances are matched to each other here in such a way that a high-quality resonance is achieved for the frequency used. Additional electrical connections must be avoided because parallel capacitances of any kind would immediately destroy the high quality. The high voltage of up to 30 kilovolts peak-to-peak is needed for the mass-sequential mass scan in order to eject heavy ions and to isolate individual ion species. In contrast, voltages of only a few hundred volts are required for storing ions of a large mass range.

The invention therefore proposes that if the ions are to be transferred to a different mass analyzer, the RF voltage generated with maximum quality by RF generator 1 is replaced with an RF voltage from RF generator 2, which can be switched down (or off) more rapidly and which usually amounts to a maximum of a few hundred volts only. Since the second RF voltage cannot be applied to the ring electrode, the invention furthermore proposes that the RF voltage of RF generator 2 is applied in a single phase on the two end cap electrodes together. For a 3D RF ion trap, the only important factor for the storage of ions is that an RF voltage is applied between the ring electrode, on the one hand, and the two end cap electrodes, on the other hand.

Figure 4:
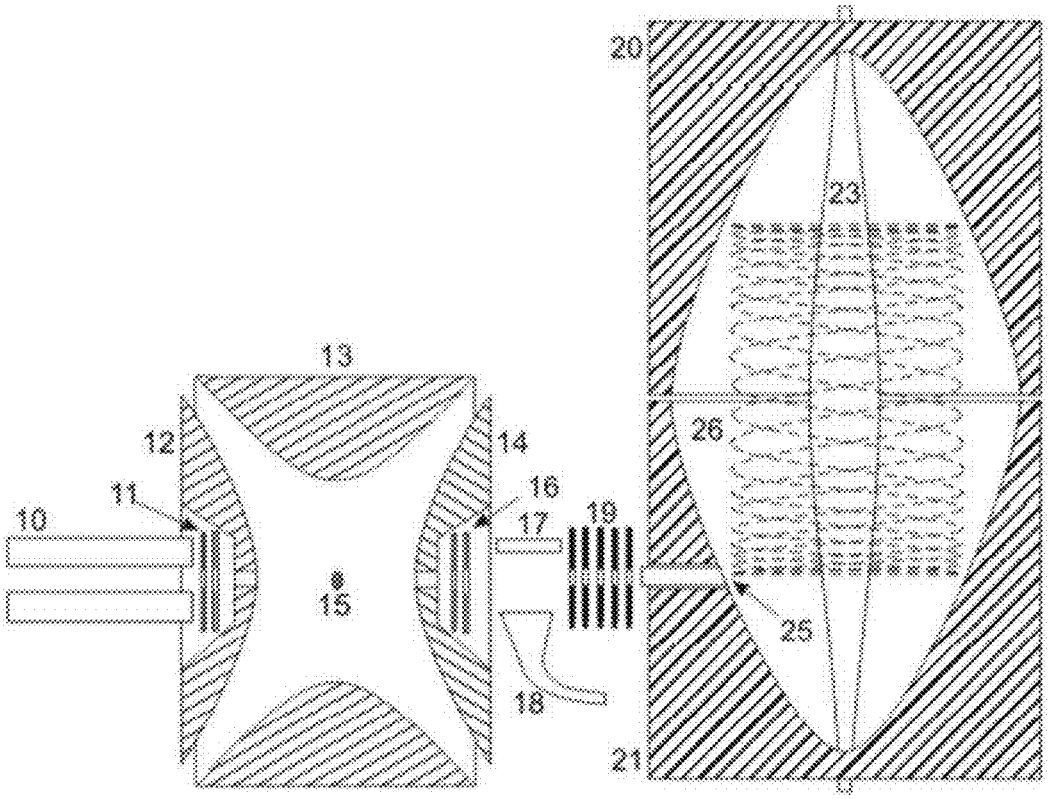
FIG. 4 shows schematically how a Kingdon ion trap can be connected to a three-dimensional Paul ion trap. After switching over and switching off the RF voltages according to the invention, and by switching on the suction voltage at the end cap electrode (14), the ions of the ion cloud (15) can be extracted from the Paul ion trap and spatially focused, accelerated by the lens system (19) to form an ion beam, and injected through the entrance tube (25) into the Kingdon ion trap. The lens system (19), which is only shown schematically and greatly simplified here, extends over several pumping stages, which are not shown here, in order to transit from a pressure of around one pascal in the Paul ion trap to a pressure of better than $10^{-6}$ pascal in the Kingdon ion trap.

The 3D RF ion trap can be operated in the familiar way and used as a mass analyzer without any loss of quality as long as the ions it contains are not to be transferred to another mass analyzer. But if the ions are to be transferred from the 3D RF ion trap to another mass analyzer at some point in time, the second single-phase RF voltage, which traps the ions in the interior of the 3D RF ion trap, is applied to the two end cap electrodes together. Switching off or switching down the ring RF voltage, which can be carried out simultaneously or with a time overlap, or after the end cap RF voltage has been powered up, takes a few hundred microseconds. The end cap RF voltage can then be switched down abruptly within one RF period, i.e. within around one microsecond, and thus significantly faster than the time required for the transition between the two RF voltages or for switching down the ring RF voltage. The changeover switch (35) is used to apply a DC voltage pulse to one of the two end cap electrodes in order to eject all the ions from the ion trap together. The voltages at the ion detector (17, 18 in FIG. 4) must also be switched off for this process. A focusing correction voltage can be applied to the other end cap electrode via the changeover switch (34).

The two RF generators 1 and 2 can generate two RF voltages which have the same frequency but opposite polarity and can be powered up and down in the contrary direction. The same RF field would then always exist in the ion trap during the transition from the pure ring RF voltage to the pure end cap RF voltage. The ion cloud would thus not be disturbed and would retain its shape, size and oscillational behavior. This embodiment does, however, entail the risk of energy being pumped into the resonant circuit at the ring electrode due to the capacitive coupling between the ring electrode and the end cap electrodes, which would again make a rapid switch-off more difficult.

Because this coupled-in RF voltage is unacceptable, it is better to decouple the two resonant circuits as best as possible by using different frequencies. This may require that the frequencies selected differ by more than a factor of two. It is advantageous to make one of the two frequencies an integer fraction of the other frequency, for example ⅜ or ⅝, and to couple the frequencies in phase-locked relationship in order to avoid beats. After the transition and a short settling period for the ion cloud, the RF voltage at the end cap electrodes (12) and (14) can then be switched down (or off) abruptly in a favorable phase of the RF period and be replaced with an ejecting DC potential. For the timing of the switch-off, it can be advantageous to also take into account the phase angle of the coupled RF voltage at the ring electrode, if this voltage continues to co-oscillate slightly although it has been switched off.

The ion cloud (15) in the center of the ion trap tends to take the shape of a flat ellipsoid of rotation with a special layered structure because the lightest ions, which are affected most by the pseudopotential, collect in the very center of the cloud. Toward the outside, the heavier ions collect in the order of their masses; the heaviest ions at the very outside. This structure periodically expands and contracts in the rhythm of the RF frequency because the force exerted by the RF voltage oscillates continuously between the centripetal and centrifugal directions. The centrifugal force exerts its maximum effect when the ion cloud has contracted, the centripetal force when expansion of the cloud is at its maximum. Since the RF potential increases quadratically toward the outside, the centripetal force acting on an ion when the ion cloud is in its expanded form, integrated over an RF period, predominates over the centrifugal force, which only acts on ions when the ion cloud has contracted: this predominance of the centripetal force over the centrifugal force, integrated over time, forms the physical background to the concept of the non-real "pseudopotential", which was developed during the 1950s by various authors independently of each other and using different designations (for example "essential potential").

In the two zero crossings of the RF voltage, the ions are in the phase of the highest velocity of either contraction or expansion of the cloud. The invention therefore proposes that the RF voltage is switched down at the end caps in the zero crossing where the cloud contracts most strongly. The cloud is then ejected while it is still contracting until it expands again under the effect of the space charge. In practice the RF voltage is preferably switched down slightly before the zero crossing. When the switch-off is done well, there is usually a small overshoot before a residual, very small DC voltage remains, but this decreases to zero volts in very few microseconds. In order to reach zero voltage rapidly when switching off, RF generator 2 for the end cap RF voltage can be operated as a circuit either with active electrical components without a transformer or with a low-resistance load resistor, which increases the energy consumption in the short phases of the generator operation but accelerates the switching off and reduces the residual voltages. The resistor should be dimensioned so that the aperiodic creep case is achieved, if possible.

For the collective ejection of the ions it is not absolutely necessary that the end cap RF voltage is switched off completely. The ions can also be successfully ejected when a small RF voltage still exists. This document therefore talks about "switching down" instead of switching off completely. However, when talking about "switching down" the variant of switching off completely shall always be included.

If the ejecting DC potential is applied as a suction voltage at the end cap electrode (14) through whose opening the ion cloud is to be ejected, the ions of the ion cloud are focused toward the opening by the DC potential distribution in the interior of the ion trap. The invention therefore proposes a suction voltage at this end cap electrode (14). It is advantageous to accelerate the ions here to a relatively high speed by means of the suction voltage and downstream acceleration lenses with a few hundred volts in order that the mass dispersion remains low during the time of flight to the high-resolution mass analyzer. A correction voltage to optimize the focusing can be applied to the other end cap electrode.

Along the path between the end cap (14) of the 3D RF ion trap and the entrance tube (25) of the Kingdon ion trap, which usually passes through several pumping stages (symbolically represented by the bundle of ion lenses (19)), the ion species are spaced out during the transfer according to their masses by the mass-dependent flight times in electric acceleration, deceleration and focusing fields; the light ions reach the Kingdon ion trap before the heavy ions. The Kingdon ion trap must therefore be suitable to accept the ions during this time-of-flight difference. If desired, a temporal focusing of ions of the same mass can be produced by selecting a suitable temporal amplitude characteristic of the DC voltage pulse. The filling of the Kingdon ion trap with the ejected ions has been described in detail in the documents DE 10 2009 020 886 B4 (already referenced above) and DE 10 2011 109 927 A1 (C. Köster; corresponding to US 2013/0037711 A1). This description is not repeated here.

In short, the invention proposes a method for the collective ejection of the ions from a 3D RF ion trap usable as a mass analyzer, which comprises the following steps: (a) the RF voltage of the high-quality circuit at the ring electrode is replaced with a more rapidly switchable RF voltage commonly applied to both end cap electrodes, (b) the RF voltage at the end cap electrodes is then rapidly switched down, and (c) a DC voltage on at least one of the end cap electrodes is switched on, ejecting the ions through an opening in one of the end cap electrodes.

The two RF voltages can have the same frequency, but phases of opposite polarity; and can be, in Step a), controlled upwards (at the end cap electrodes) and downwards (at the ring electrode) in the contrary direction. But it appears better to select two different frequencies. One can be an integer fraction of the other, for example, and they can then be coupled together in phase-locked relationship. Switching down the RF voltage at the end cap electrodes in Step b) should take place in or shortly before the zero crossing. It is advantageous to switch down this voltage in the zero crossing where the ion cloud contracts.

It is also advantageous if, in Step c), the DC voltage for the ejection of the ions is applied as a suction voltage at the end cap electrode through whose opening the ions are to be ejected. A voltage at the other end cap electrode can be used for fine adjustment of the focusing. The ions ejected in Step c) can be transferred to a mass analyzer with high mass resolution, preferably a Kingdon ion trap as the mass analyzer. A temporal change in the DC voltage for the ejection of the ions can also bring about a temporal focusing for ions of the same mass, and also of different masses.

The invention provides a mass spectrometer with a 3D RF ion trap which comprises a first RF generator to supply a high-quality RF voltage to the ring electrode, and a second RF generator for a single-phase, more rapidly switchable RF voltage for the two end cap electrodes.

Those skilled in the art can easily work out further interesting applications on the basis of the devices and methods according to the invention for the ejection of ions in order to transfer them to other mass analyzers. These applications shall also be covered by this patent protection application for the part which is subject to this invention.

The invention claimed is:

1. A method for a collective ejection of ions from a 3D RF ion trap having a ring electrode and two end cap electrodes, comprising the steps:

a) initially storing the ions by an RF voltage at the ring electrode, b) replacing the RF voltage at the ring electrode with a more rapidly switchable RF voltage at the two end cap electrodes to keep the ions stored, c) switching down abruptly the RF voltage at the end cap electrodes, and d) applying a DC voltage to at least one of the end cap electrodes to eject the ions through an opening in one of the end cap electrodes.

2. The method according to claim 1, wherein the two RF voltages have the same frequency but phases of opposite polarity; and in Step b), the amplitudes of the two RF voltages are increased and decreased in the contrary direction, respectively.

3. The method according to claim 1, wherein the two RF voltages have different frequencies.

4. The method according to claim 3, wherein a value of one of the frequencies corresponds to an integer fraction of a frequency of the other RF voltage.

5. The method according to claim 4, wherein the two frequencies are coupled in phase-locked relationship.

6. The method according to claim 3, wherein in Step b) the amplitudes of the RF voltages are decreased and increased in the contrary direction, respectively.

7. The method according to claim 1, wherein the RF voltage at the end cap electrodes is switched down in or shortly before a zero crossing.

8. The method according to claim 7, wherein the switching down takes place near the zero crossing in which the ion cloud contracts.

9. The method according to claim 1, wherein in Step d) the DC voltage for the ejection of the ions is applied as a suction voltage at the end cap electrode through whose opening the ions are ejected.

10. The method according to claim 9, wherein a voltage at the other end cap electrode is used for fine adjustment of the spatial focusing of the ejected ions.

11. The method according to claim 9, wherein the DC voltage at the end cap electrode is changed temporally in order to achieve a temporal focusing of the ions of one ion species or a temporal compression of ions of different masses.

12. The method according to claim 1, wherein the ejected ions are transferred to a mass analyzer of high mass resolution.

13. The method according to claim 12, wherein the ejected ions are transferred to a Kingdon ion trap.

14. A mass spectrometer with a 3D RF ion trap, the trap comprising a ring electrode and two end cap electrodes, wherein a first RF generator is connected to the ring electrode and a second RF generator is connected so as to provide the same phase of an RF voltage to the two end cap electrodes, and a DC voltage generator is connected to at least one of the end cap electrodes, wherein the second RF generator can change the generated RF voltage more rapidly than the first RF generator.

15. The mass spectrometer according to claim 14, comprising an ion source and a Kingdon ion trap.

16. The mass spectrometer according to claim 14 wherein the second RF generator comprises a resonant circuit under strong damping conditions.

17. The mass spectrometer according to claim 14 wherein the second RF generator comprises active electrical switching elements.

18. The mass spectrometer according to claim 17 wherein said active electrical switching elements comprise at least one power transistor.

19. The mass spectrometer according to claim 14 wherein the second RF generator comprises a resonant circuit that is in resonance if it has a quality factor that is lower than that of a resonant circuit of the first RF generator.

* * * * *